US011402783B2

(12) United States Patent
Fukazawa

(10) Patent No.: US 11,402,783 B2
(45) Date of Patent: Aug. 2, 2022

(54) IMAGE FORMING APPARATUS HAVING DETECTION UNIT WITH SHUTTER

(71) Applicant: CANON KABUSHIKI KAISHA, Tokyo (JP)

(72) Inventor: Toshiya Fukazawa, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/359,017

(22) Filed: Jun. 25, 2021

(65) Prior Publication Data

US 2022/0004133 A1 Jan. 6, 2022

(30) Foreign Application Priority Data

Jul. 2, 2020 (JP) ..... JP2020-114839

(51) Int. Cl.
*G03G 15/00* (2006.01)
*G03G 21/16* (2006.01)

(52) U.S. Cl.
CPC ..... *G03G 15/5041* (2013.01); *G03G 15/5058* (2013.01); *G03G 15/5062* (2013.01); *G03G 21/168* (2013.01); *G03G 21/1633* (2013.01); *G03G 2215/00042* (2013.01); *G03G 2215/00059* (2013.01); *G03G 2215/00616* (2013.01)

(58) Field of Classification Search
CPC ..... G03G 15/5041; G03G 15/5058; G03G 15/5062; G03G 15/0855; G03G 15/0862; G03G 2215/00042; G03G 2215/00059; G03G 2215/00067; G03G 2215/00616; G03G 2215/0062
USPC ..... 399/49, 74
See application file for complete search history.

(56) References Cited

U.S. PATENT DOCUMENTS

2009/0180803 A1* 7/2009 Tomita ..... G03G 15/0131 399/121
2009/0208245 A1* 8/2009 Sato ..... G03G 21/1828 399/111
2016/0313685 A1* 10/2016 Yamana ..... G03G 15/5041

FOREIGN PATENT DOCUMENTS

JP 2011227244 A * 11/2011
JP 2015-143804 A 8/2015
KR 20160036919 * 4/2016

* cited by examiner

*Primary Examiner* — Robert B Beatty
(74) *Attorney, Agent, or Firm* — Venable LLP

(57) ABSTRACT

An image forming apparatus includes an image bearing member, an image forming unit, a detection unit, and a control portion. The detection unit includes a casing, an optical sensor, a shutter portion, a moving member, a groove portion, and a projection portion. The optical sensor is disposed within the casing facing the image bearing member to detect the toner image and comprises a light emitting portion emitting light to the image bearing member through the opening portion and a light receiving portion receiving the light reflected from the image bearing member. The shutter is configured to open/close the opening portion as the projection portion moves in a direction intersecting with the predetermined direction as the moving member moves in the predetermined direction. The groove portion is disposed perpendicularly above an extension line of an optical axis of the light irradiated from the light emitting portion to the image bearing member.

12 Claims, 14 Drawing Sheets

IMAGE FORMING APPARATUS HAVING DETECTION UNIT WITH SHUTTER

BACKGROUND OF THE INVENTION

Field of the Invention

The present invention relates to an image forming apparatus using an electro-photographic system or an electrostatic recording system such as a copier, a printer, a facsimile machine and a multifunction machine having such plurality of functions and to a cartridge.

Description of the Related Art

An image forming apparatus is configured to visualize an image by applying toner to an electrostatic latent image formed on an image bearing member such as a photosensitive drum. Hitherto, there has been known a configuration of providing a detection unit configured to detect a toner image formed on the image bearing member to adjust a condition for forming the toner image based on a detection result of the detection unit. Then, as such detection unit, there has been known a system having a light emitting portion and a light receiving portion configured to receive a reflection light of the light emitting portion and photoelectrically converting a level of the received light by using an optical sensor configured to detect the toner image without contact.

Still further, a detection unit in which a shutter mechanism for opening/closing an opening portion where a surface of a sensor is exposed and an optical sensor are unitized is known in order to protect the sensor surface of such optical sensor to keep a photosensitive level constant as disclosed in Japanese Patent Application Laid-open No. 2015-143804 for example. This detection unit reduces an opening/closing stroke of the shutter by setting an opening/closing direction of the shutter in a direction orthogonal to a predetermined direction which is a drive input direction. This arrangement permits to save space, to shorten an operation time required for opening/closing the shutter and to prevent scattering toner from adhering on the surface of the sensor.

However, the detection unit disclosed in Japanese Patent Application Laid-open No. 2015-143804 has had such a problem that foreign substances such as carriers may infiltrate into a casing of the detection unit from the shutter when the shutter is opened and may infiltrate into a sliding portion in an opening/closing mechanism of the shutter. In a case where a developing unit is located above the detection unit in particular, the foreign substances fallen from the developing unit tend to infiltrate inside of the casing of the detection unit from the opened shutter. If such shutter opening/closing operations are repeated in this state, the foreign substances caught in the sliding portion of the opening/closing mechanism of the shutter get stuck on a resin surface of the sliding portion. Then, there is a possibility of inducing an increase of a sliding resistance by scratching a resin surface of a counterpart component by sliding while catching the foreign substances. As a result, an opening/closing failure of the shutter may occur in a short period of time which is significantly shorter than a life assumed from wear caused by friction, possibly increasing a downtime of the image forming apparatus and a replacement load of a service person.

Accordingly, the present disclosure aims at providing an image forming apparatus and a cartridge provided with a detection unit capable of suppressing wear of an opening/closing mechanism of a shutter. That is, the present disclosure aims at providing an image forming apparatus capable of suppressing the wear of the opening/closing mechanism of the shutter.

SUMMARY OF THE INVENTION

According to a first aspect of the present invention, an image forming apparatus includes a rotatable image bearing member, an image forming unit configured to form an image on the image bearing member, a detection unit configured to detect a toner image formed on the image bearing member, and a control portion configured to control the image forming unit based on a detection result of the detection unit. The detection unit comprises a casing having an opening portion, an optical sensor disposed within the casing facing the image bearing member to detect the toner image and comprising a light emitting portion configured to emit light to the image bearing member through the opening portion and a light receiving portion configured to receive the light reflected from the image bearing member, a shutter portion comprising a shutter configured to open/close the opening portion, a moving member configured to reciprocally move along a predetermined direction, a groove portion provided on the moving member and extended in a direction intersecting with the predetermined direction, and a project portion provided on the shutter portion and engaging with the groove portion. The shutter is configured to open/close the opening portion as the project portion moves in a direction intersecting with the predetermined direction as the moving member moves in the predetermined direction. The groove portion is disposed perpendicularly above an extension line of an optical axis of the light irradiated from the light emitting portion to the image bearing member.

According to a second aspect of the present invention, an image forming apparatus includes a rotatable image bearing member, an image forming unit configured to form an image on the image bearing member, a detection unit configured to detect a toner image formed on the image bearing member, and a control portion configured to control the image forming unit based on a detection result of the detection unit. The detection unit comprises a casing having an opening portion, an optical sensor disposed within the casing facing the image bearing member to detect the toner image and comprising a light emitting portion configured to emit light to the image bearing member through the opening portion and a light receiving portion configured to receive the light reflected from the image bearing member, a shutter portion comprising a shutter configured to open/close the opening portion, a moving member configured to reciprocally move along a predetermined direction, a groove portion provided on the shutter portion and extended in a direction intersecting with the predetermined direction, and a project portion provided on the moving member and engaging with the groove portion. The shutter is configured to open/close the opening portion as the groove portion moves in a direction intersecting with the predetermined direction as the moving member moves in the predetermined direction. The groove portion is disposed perpendicularly above an extension line of an optical axis of the light irradiated from the light emitting portion to the image bearing member.

Further features of the present invention will become apparent from the following description of exemplary embodiments with reference to the attached drawings.

DESCRIPTION OF THE EMBODIMENTS

An exemplary embodiment of the present disclosure will be described with reference to FIGS. 1 through 13. Firstly, a structure of an image forming apparatus of the present exemplary embodiment will be schematically described with reference to FIGS. 1 and 2. It is noted that as for dimensions, materials, shapes relative dispositions and others of components described in the following exemplary embodiment, a scope of the present disclosure is not intended to be limited only to those described in the following exemplary embodiment unless otherwise specifically described. Still further, while the following description will be made by exemplifying an image forming apparatus configured to form a full-color image as one exemplary image forming apparatus, it is needless to say that the image forming apparatus to which a developing unit of the present exemplary embodiment is applicable is not limited to such apparatus.

Image Forming Apparatus

Figure 1:
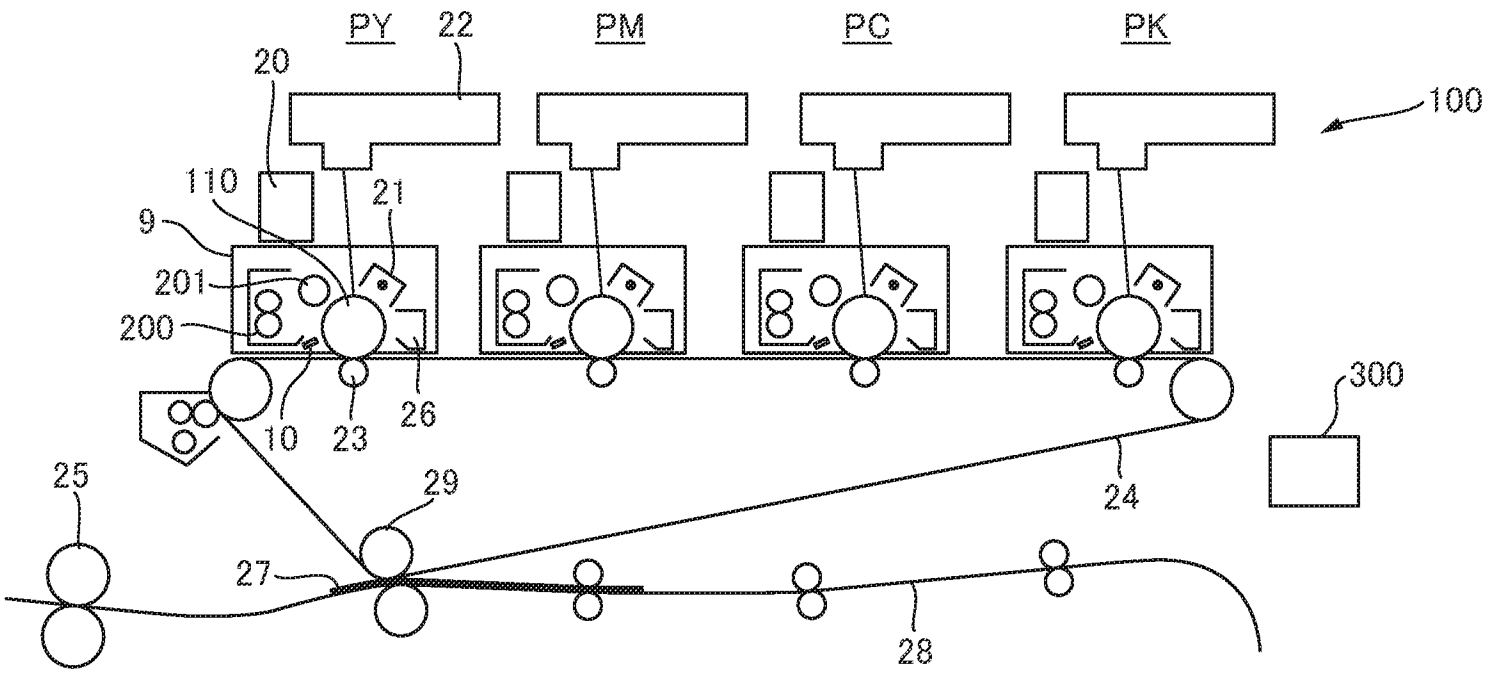
FIG. 1 is a schematic diagram illustrating a configuration of an image forming apparatus according to a present exemplary embodiment of the present disclosure.

As illustrated in FIG. 1, the image forming apparatus 100 of the present exemplary embodiment includes image forming units, i.e., image forming stations, PY, PM, PC and PK configured to form images of yellow (Y), magenta (M), cyan (C) and black (K), respectively. These image forming units PY, PM, PC and PK are arrayed respectively in a rotation direction of an intermediate transfer belt 24. In the present exemplary embodiment, because the image forming units PY, PM, PC and PK are constructed almost in the same manner other than that colors of toners are different, the following description will be made by typically exemplifying the yellow image forming unit PY and by omitting descriptions of the other image forming units PM, PC and PK.

A photosensitive drum 110 serving as an image bearing member is provided to be rotatable and a surface thereof is homogeneously charged by a primary charger 21. Then, an electrostatic latent image is formed on the surface of the homogeneously charged photosensitive drum 110 by exposing with light such as a laser beam modulated by an exposing unit 22 corresponding to information signals. The electrostatic latent image thus formed is visualized, i.e., developed, by a developing unit 200 as a toner image on the photosensitive drum 110. A two-component developing method of using toner and carrier is adopted in the present exemplary embodiment. The developing unit 200 includes a developing sleeve 201 which is one example of a developer bearing member that is capable of developing the electrostatic latent image on the photosensitive drum 110 as the toner image by developer.

In the present exemplary embodiment, the photosensitive drum 110, the primary charger 21, the developing unit 200 and a cleaning unit 26 are unitized as a process cartridge 9 that can be attached to the image forming apparatus 100. The process cartridge 9 is provided above the intermediate transfer belt 24 and is provided with a sensor unit 10 configured to detect the toner image formed on the photosensitive drum 110 as described later.

Next, the visualized image, i.e., the toner image, is transferred by a primary transfer roller 23 onto the intermediate transfer belt 24. At this time, the toner images of the respective colors are sequentially superimposed from the respective image forming units PY, PM, PC and PK onto the intermediate transfer belt 24 and are conveyed to a secondary transfer portion 29. Then, the toner images are secondarily transferred onto a sheet material, i.e., recording material, 27 such as a sheet of paper or an OHP sheet that has been conveyed along a recording material conveyance path 28 at the secondary transfer portion 29. The recording material 27 onto which the toner images are laid is conveyed further to a fixing unit 25 to fix the image. Meanwhile, transfer residual toner left on the photosensitive drum 110 is removed by the cleaning unit 26. Toner is supplied from a toner replenishing tank 20 to replenish the toner consumed in the image forming operation. Note that carrier is also replenished together with the toner from the toner replenishing tank 20.

Sensor Unit

Figure 2:
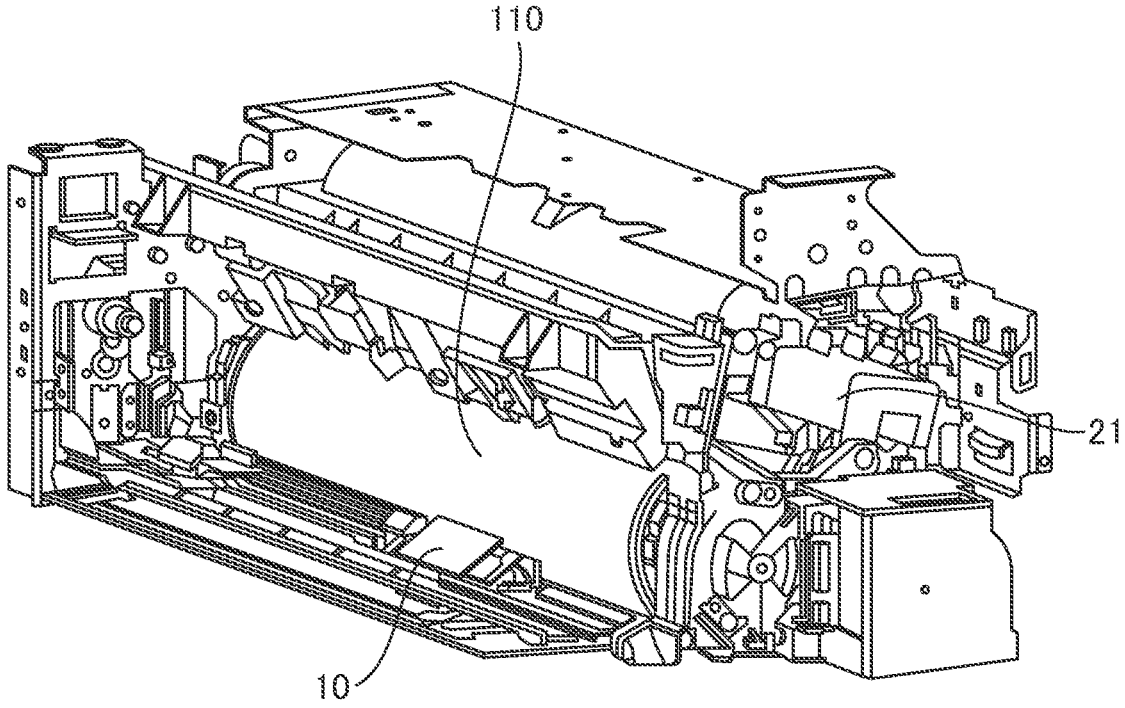
FIG. 2 is a perspective view illustrating a state of an image forming unit of the present exemplary embodiment viewed from a sensor unit by cutting away a part of the image forming unit.

According to the present exemplary embodiment, the sensor unit 10 is disposed at a position facing the photosensitive drum 110 as one example of the detection unit as illustrated in FIGS. 1 and 2. The sensor unit 10 detects a toner image to be detected, i.e., a patch image, formed under a condition set in advance by a control portion 300 on the photosensitive drum 110. Then, the control portion 300 controls the exposing unit 22 and the developing unit 200 based on detection results of the sensor unit 10.

More specifically, as illustrated in FIGS. 1 and 2, the sensor unit 10 is disposed downstream of a developing portion of the developing unit 200 in a rotation direction of the photosensitive drum 110 and upstream of a primary transfer portion where the primary transfer is conducted by the primary transfer roller 23. That is, the sensor unit 10 is disposed under a developing sleeve 201 (see FIG. 1). Then, the sensor unit 10 is disposed at a position corresponding to a position where the patch image is formed in terms of a bus line direction, i.e., a rotation axial direction, of the photosensitive drum 110. The sensor unit 10 is provided at a position corresponding to an approximately center part of the photosensitive drum in the rotation axial direction in the present exemplary embodiment.

Figure 3:
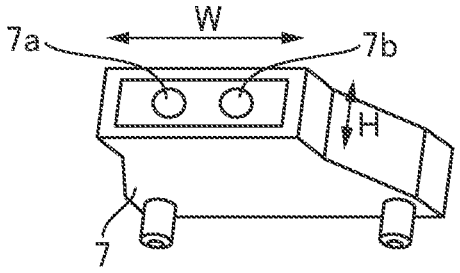
FIG. 3 is a perspective view illustrating a concentration sensor assembled into the sensor unit of the present exemplary embodiment.

As illustrated in FIG. 3, the sensor unit 10 includes a concentration sensor 7 serving as a detection portion. The concentration sensor 7 is an optical sensor configured to detect a toner image without contact and is composed of a light emitting portion 7*a* and a light receiving portion 7*b* into which a reflection light of the light emitting portion 7*a* is inputted. According to the present exemplary embodiment, an optical axis of the beam irradiated from the light emitting portion 7*a* to the photosensitive drum 110 is set in a direction of passing through the rotation axial direction of the photosensitive drum 110. That is, the concentration sensor 7 is disposed so as to face the photosensitive drum 110 within the casing 5 and can detect the toner image without contact by having the light emitting portion 7*a* irradiating the photosensitive drum 110 with the light emitted through an opening portion 6 and the light receiving portion 7*b* receiving the light reflected from the photosensitive drum 110.

The light emitting portion 7*a* and the light receiving portion 7*b* are arrayed in the rotation axial direction of the photosensitive drum 110. As a result, a length of a sensor detecting surface in the rotation axial direction of the photosensitive drum 110 composed of the light emitting portion 7*a* and the light receiving portion 7*b* of the concentration sensor 7 is longer than a length of the sensor detecting surface in a direction orthogonal to the rotation axial direction of the photosensitive drum 110. The concentration sensor 7 photo-electrically converts a level of the light received by the light receiving portion 7*b* and transmits it as a detection signal to the control portion 300. The control portion 300 controls variously based on this detection signal.

Figure 4:
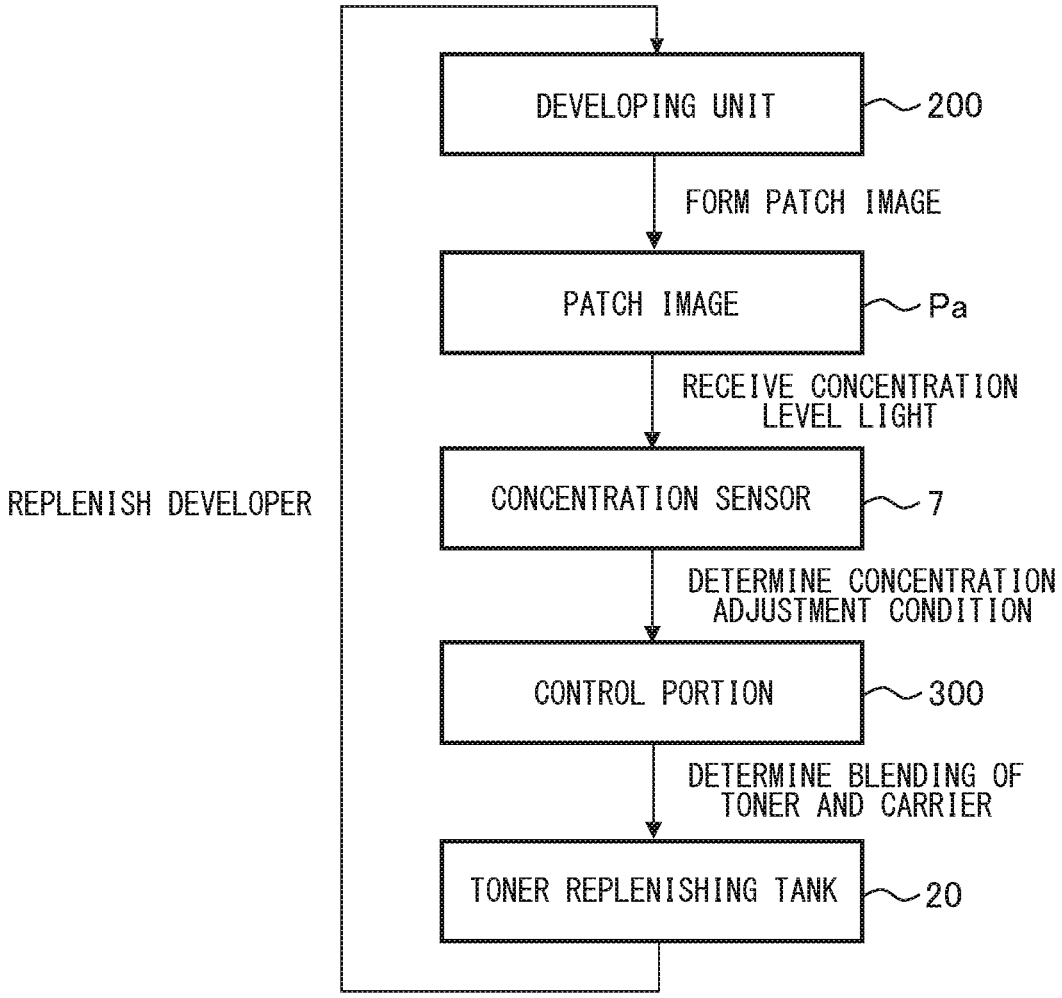
FIG. 4 is a block diagram illustrating a procedure for adjusting concentration in the image forming apparatus of the present exemplary embodiment.

That is, as illustrated in FIG. 4 and under a command of the control portion 300, an electrostatic latent image is formed onto the photosensitive drum 110 under a condition set in advance and is developed by the developing unit 200 to form a patch image Pa. The patch image Pa thus formed is detected by the concentration sensor 7 of the sensor unit 10 and a detection result is transmitted to the control portion 300. Based on the detection result, the control portion 300 adjusts an image forming condition such as a development condition or an electrostatic latent image forming condition such that concentration is so determined that the toner image has a predetermined concentration. For instance, the control portion 300 adjusts blending of toner and carrier by adjusting an amount of the toner replenished from the toner replenishing tank 20 to the developing unit 200.

Figure 5:
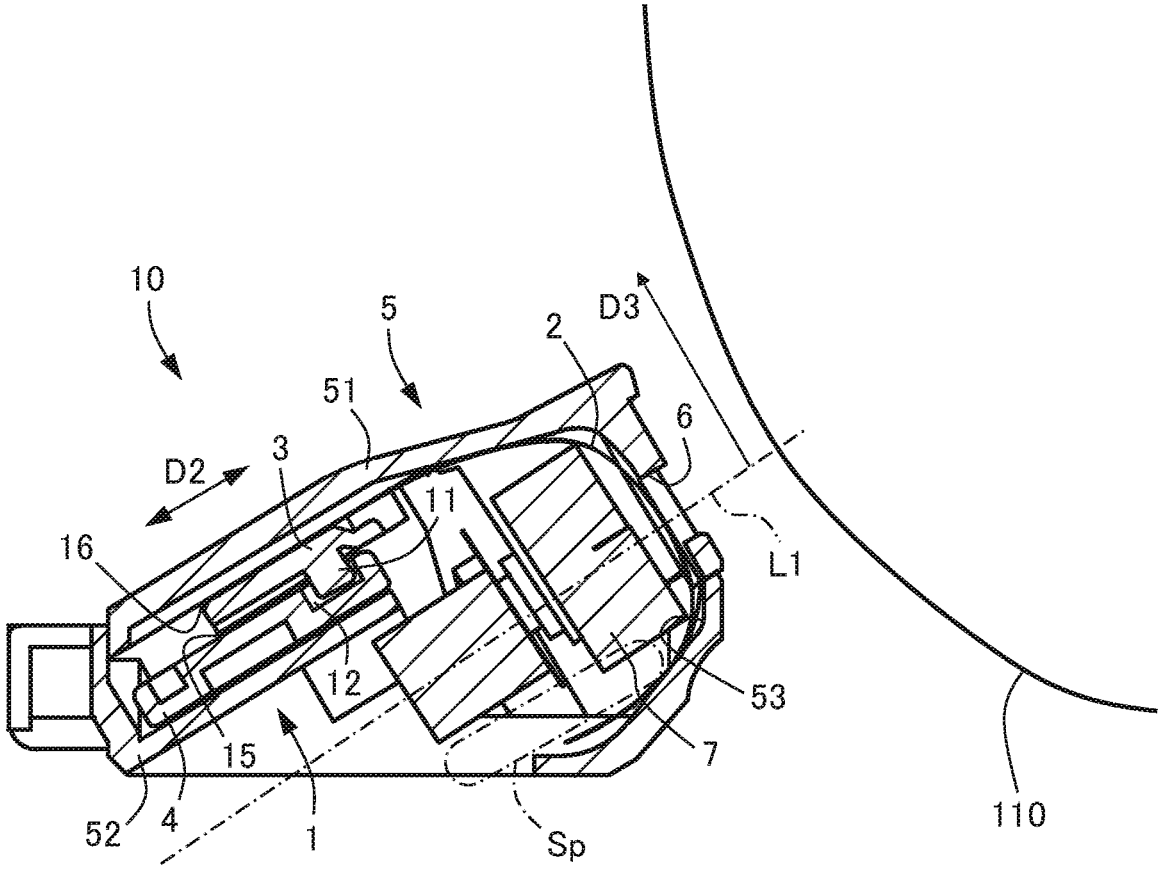
FIG. 5 is a section view illustrating the sensor unit of the present exemplary embodiment.
Figure 6:
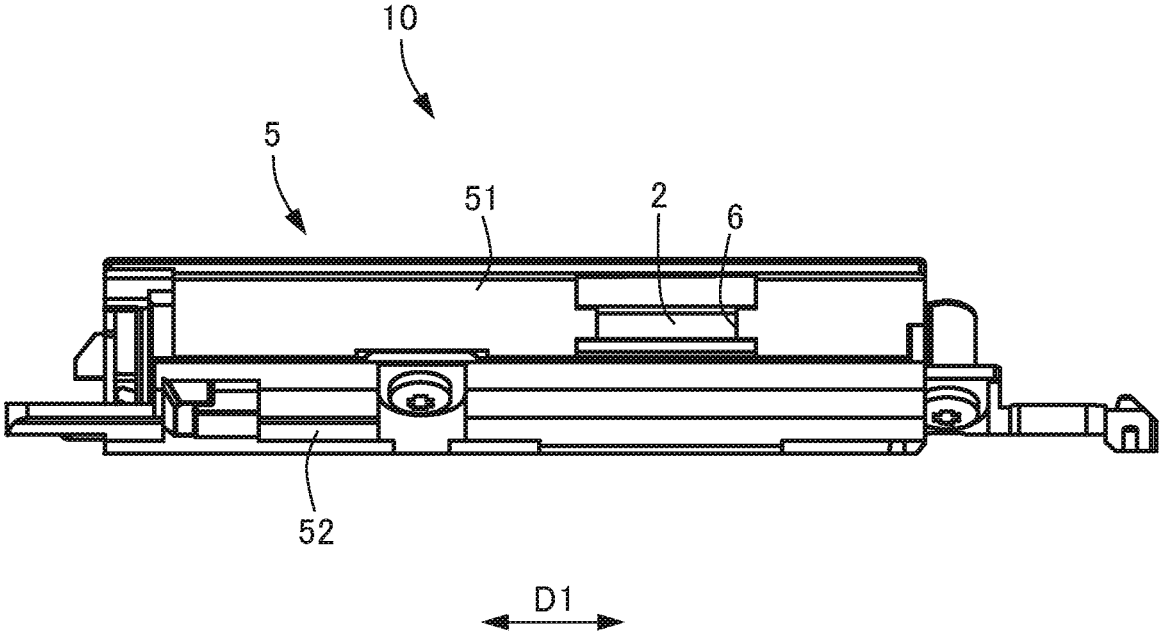
FIG. 6 is a front view illustrating the sensor unit of the present exemplary embodiment viewed from an opening portion side thereof.
Figure 7:
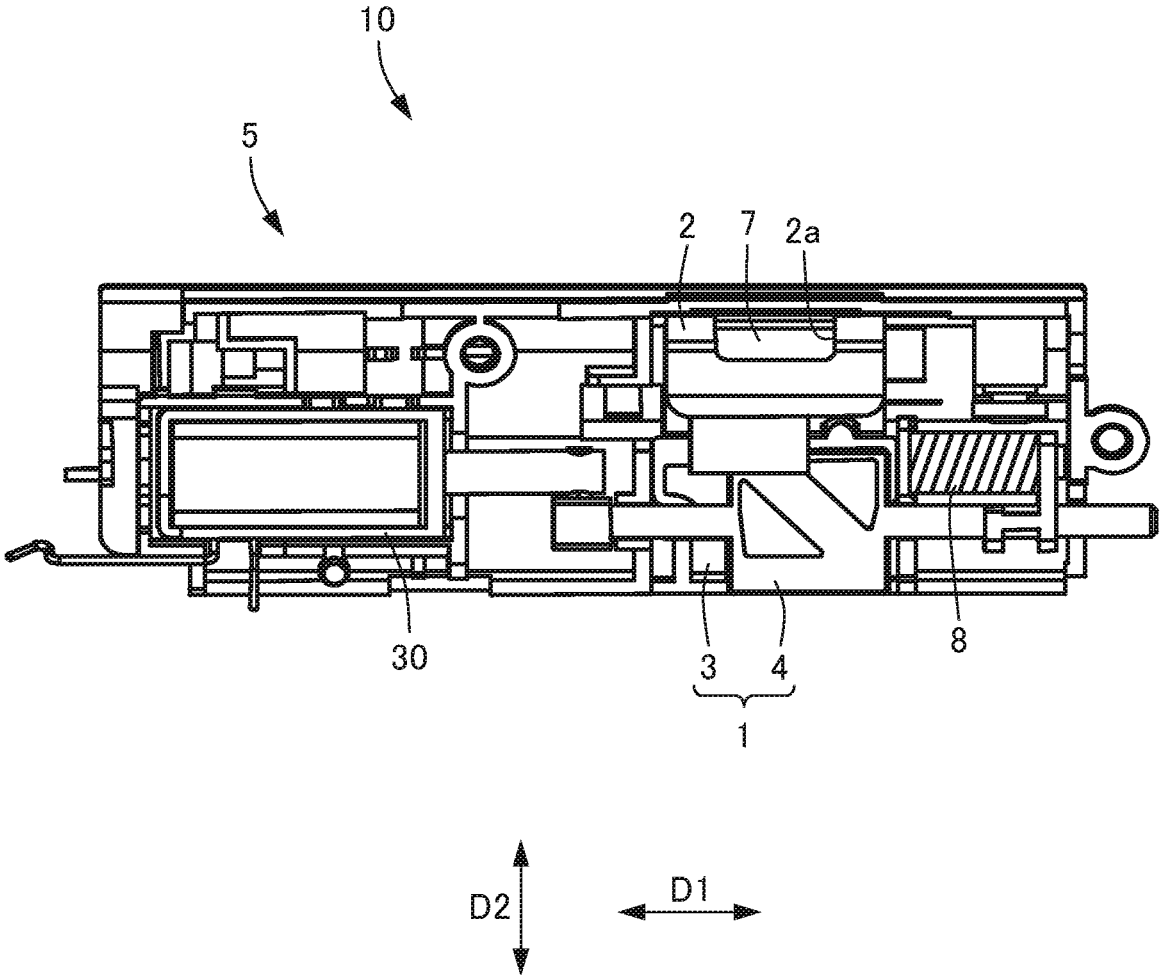
FIG. 7 is a bottom view illustrating the sensor unit of the present exemplary embodiment from which a concentration sensor is omitted.

The sensor unit 10 constructed as described above includes the casing 5, the concentration sensor 7, a shutter 2 and a shutter mechanism 1 serving as an opening/closing mechanism for opening/closing the shutter 2 as illustrated in FIGS. 5 through 7. The casing 5 is composed of a pair of dividable casing elements 51 and 52 and has an opening portion 6 at a part thereof facing the photosensitive drum 110 (see FIG. 6). The concentration sensor 7 is disposed within the casing 5 such that the sensor detecting surface faces the opening portion 6 and detects the toner image without contact through the opening portion 6 as described above. The shutter 2 is formed of a film in order to reduce an operating mass and is freely capable of opening/closing the opening portion 6.

The sensor unit 10 thus constructed stores the concentration sensor 7 in a closed space by the casing 5 and the shutter 2 to protect the concentration sensor 7 from scattered toner or the like when the sensor unit 10 is not in use. When the sensor unit 10 is used in detecting the patch image Pa for example, the shutter 2 is opened to expose the sensor detecting surface of the concentration sensor 7 out of the casing 5 through the opening portion 6 such that the sensor detecting surface faces the surface of the photosensitive drum 110. When the sensor unit 10 is not in use on the other hand, the shutter 2 is closed to protect the sensor detecting surface from the scattered toner and others.

Note that it is preferable to form the shutter 2 so as to have an emboss-finished internal surface to reduce glossiness of the surface of the film in order to lower the light-receiving level of the light receiving portion 7*b* when the shutter 2 is closed. This arrangement makes it possible to diffuse the light by irregularly reflecting the sensor light when the opening portion 6 is closed by the shutter 2 and to suppress the sensor light from reaching the light receiving portion 7*b*.

Here, the concentration sensor 7 of the present exemplary embodiment is disposed such that a sensor longitudinal direction is made parallel with the rotation axial direction of the photosensitive drum 110 (see FIG. 3). This arrangement enables the shutter mechanism 1 to shorten an operation time by operating/closing in a sensor lateral direction orthogonal to the sensor longitudinal direction and to detect toner concentration accurately in a shorter time. That is, an opening operation time of the shutter 2 can be shortened and a function for protecting the concentration sensor 7 from the scattered toner can be enhanced by shortening an operation stroke of the shutter 2 in the lateral direction, not in the longitudinal direction. Still further, the sensor unit 10 can be downsized and lightened as compared to a case where the shutter 2 is operated in the sensor longitudinal direction.

More specifically, according to the present exemplary embodiment, sizes of the concentration sensor 7 are set to be a width W=15 mm and a height H=5 mm. Due to that, the stroke of the shutter 2 to open the concentration sensor 7, i.e., a required shutter stroke=15 mm or more in a case where the shutter operation is made in the sensor longitudinal direction and a required shutter stroke=5 mm or more in a case where the shutter operation is made in the sensor lateral direction. In the present exemplary embodiment, a direction of the operation of the shutter 2 of the shutter mechanism 1 is set in the lateral direction of the concentration sensor 7, so that the shutter stroke is 5 mm.

Shutter Mechanism

To that end, the shutter mechanism 1 includes a shutter lever 4 serving as a moving member and a shutter slider 3 serving as a shutter member as illustrated in FIGS. 5 through 13. Then, the shutter mechanism 1 has a conversion function of converting a movement of the shutter lever 4 in the rotation axial direction of the photosensitive drum 110 into a movement of the shutter slider 3 and the shutter 2 in a direction orthogonal to the rotation axial direction.

The shutter lever 4 and the shutter slider 3 are arranged such that the shutter slider 3 is positioned gravitationally above the shutter lever 4 so as to relatively move by sliding with each other. The shutter slider 3 is disposed right under the casing element 51 located at an upper side of the casing 5 and relatively moves by sliding with each other. The shutter lever 4 is disposed on an upper surface of the casing element 52 located at a lower side of the casing 5 and relatively moves by sliding with each other. Accordingly, the shutter slider 3 is disposed between a part of the casing 5 and the shutter lever 4. Specifically, the shutter slider 3 is sandwiched between the casing element 51 and the shutter lever 4 and relatively moves while sliding with the respective members. Still further, the shutter lever 4 is disposed between a part of the casing 5 and the shutter slider 3. Specifically, the casing 5 is sandwiched between the casing element 52 and the shutter slider 3 and relative moves while sliding with the respective members.

In a case of the present exemplary embodiment, the shutter lever 4 moves reciprocally along a predetermined direction, i.e., the sensor longitudinal direction. Specifically, the shutter lever 4 moves reciprocally in the predetermined direction, i.e., in a direction D1 illustrated in FIG. 7. The shutter lever 4 that transmits a driving force thus to the shutter 2 is driven by a solenoid 30 serving as a driving unit that applies the driving force for opening/closing the shutter 2. That is, the shutter lever 4 is moved by the solenoid 30 in the predetermined direction, i.e., in a drive input direction.

It is noted that because operational positions of the shutter 2 are two positions of the open state and the close state and it is not necessary to control the shutter 2 in an intermediate position of the movable range in a case of the present exemplary embodiment, that which makes linear reciprocal operations, such as the solenoid, is preferable as the driving source rather than that which makes a rotational drive such as a motor. Because an operational force and the operation stroke of the shutter 2 are both small, a small type solenoid is adopted as the driving source to achieve miniaturization and low cost.

The shutter slider 3 is reciprocally movable along a direction intersecting with the predetermined direction in a body with the shutter 2. In the present exemplary embodiment, the shutter slider 3 is reciprocally movable in a direction orthogonal to the predetermined direction, i.e., the moving direction of the shutter lever 4, and reciprocally moves in a direction D2 as illustrated in FIG. 7. Then, a driven direction of the shutter slider 3 with respect to the driving direction of the shutter lever 4 is converted by 90 degrees by a cam mechanism provided in the shutter lever 4 and the shutter slider 3. Then, the shutter slider 3 is slid in a direction B orthogonal to the shutter lever 4 by an equal moving amount with a moving amount of the shutter lever 4.

Figure 8:
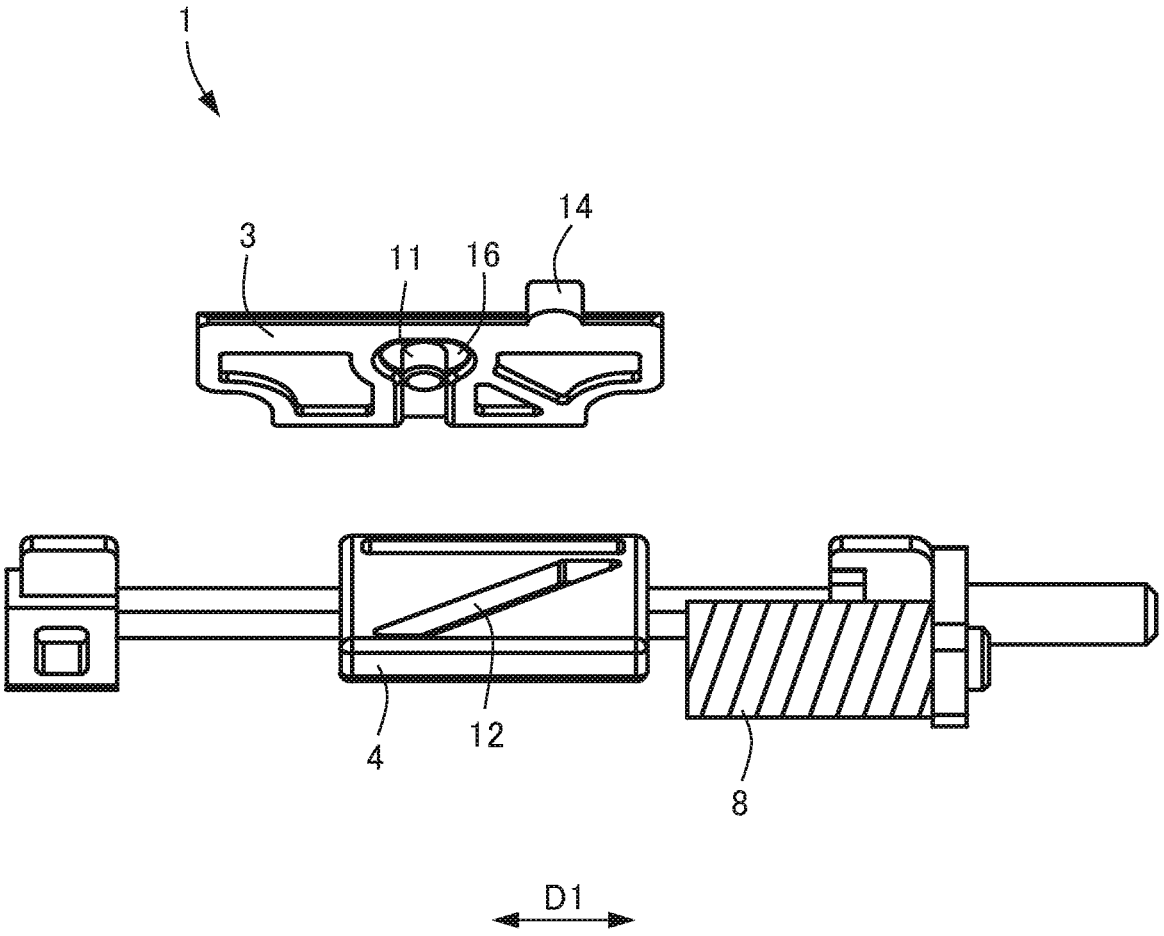
FIG. 8 is an exploded perspective view illustrating a state in which a shutter lever and a shutter slider of the sensor unit of the present exemplary embodiment are decomposed.

Still further, according to the present exemplary embodiment, a return spring 8 composed of a compression coil spring is provided between the shutter lever 4 and a fixed part of the sensor unit 10 as illustrated in FIGS. 7 and 8 to apply an urging force to the shutter lever 4 in a right direction in FIG. 7.

Accordingly, in a case of the present exemplary embodiment, the shutter lever 4 is moved in a left direction in FIG. 7 by energizing and turning on the solenoid 30 and thus the shutter 2 is opened. At this time, the return spring 8 is elastically compressed. Meanwhile, the shutter lever 4 is moved in the right direction in FIG. 7 and closes the shutter 2 by an elastic restoring force of the return spring 8 when the energization of the solenoid 30 is stopped and is turned off. It is noted that such arrangement for driving the shutter lever 4 is not limited to be the solenoid 30 and may be made by a motor for example.

Cam Mechanism

The cam mechanism provided in the shutter lever 4 and the shutter slider 3 will be described in detail with reference to FIG. 8. Although FIG. 8 separately illustrates the shutter slider 3 and the shutter lever 4, a sliding boss 11 of the shutter slider 3 actually engages with a groove portion 12 of the shutter lever 4 and is movable within the groove portion 12.

Figure 9:
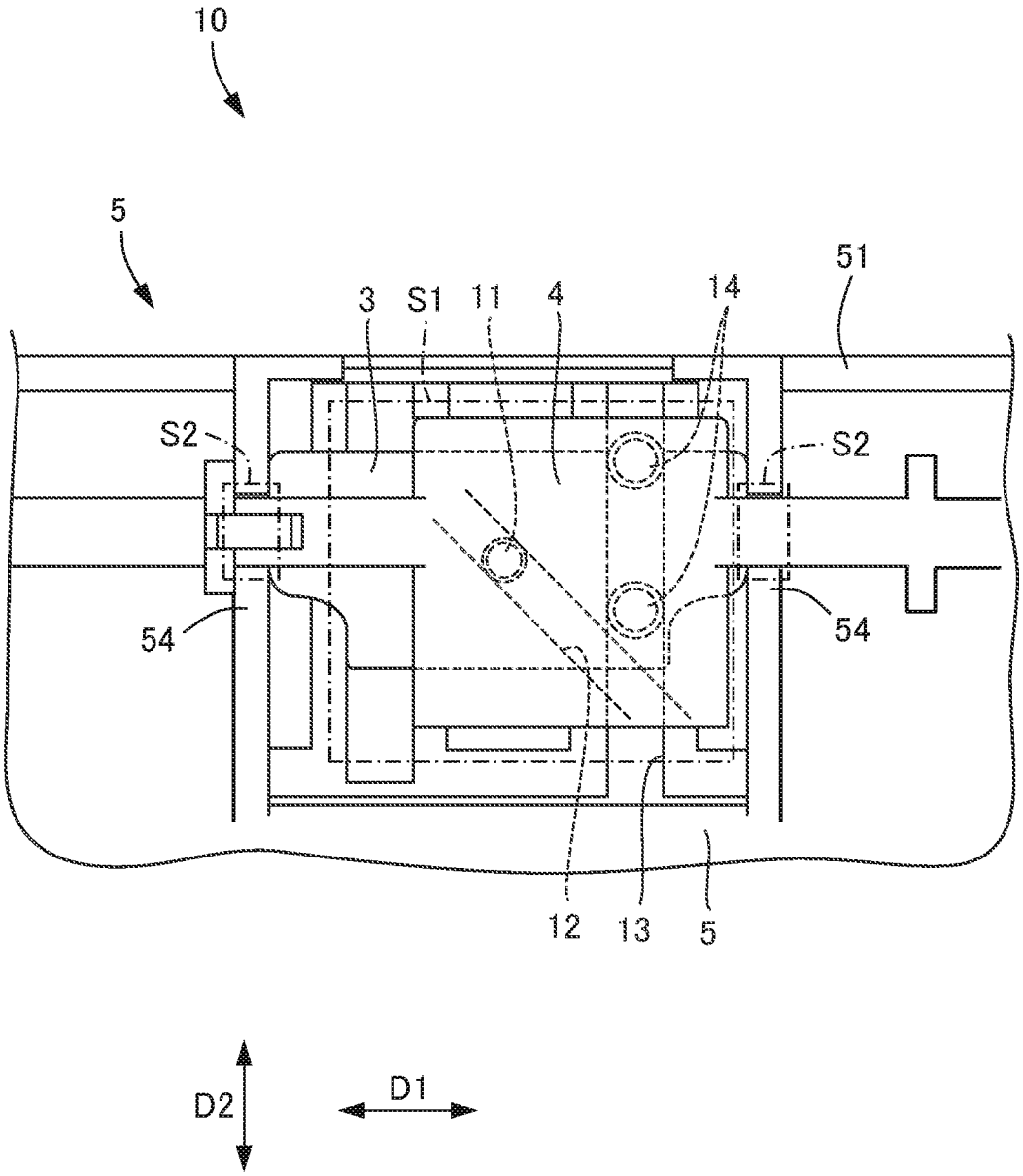
FIG. 9 is a bottom view illustrating a cam mechanism of the shutter lever and the shutter slider of the sensor unit of the present exemplary embodiment.

That is, the shutter slider 3 is provided with the cylindrical sliding boss 11 which is one example of an engaged portion, and the shutter lever 4 is provided with the groove portion 12 which is one example of an engaging portion. When the shutter lever 4 moves as illustrated in FIG. 9, the groove portion 12 moves in the direction D1. As the sliding boss 11 abuts and presses a side surface of the groove portion 12, the shutter slider 3 moves in the direction D2 along with the movement of the groove portion 12. That is, the sliding boss 11 and the groove portion 12 are relatively movably engaged. That is, the shutter slider 3 opens/closes the shutter 2 by reciprocally moving along the direction D2 intersecting with the direction D1 as the sliding boss 11 and the groove portion 12 relatively move by the reciprocal movement of the shutter lever 4.

While the shutter slider 3 moves while rubbing the shutter lever 4, the shutter slider 3 also moves while rubbing the casing 5. As illustrated in FIG. 8, the rubbing movement of the shutter lever 4 is attained by the sliding boss 11 provided on a sliding surface of the shutter slider 3 with the shutter lever 4 and the groove portion 12 of the shutter lever 4. Meanwhile, the rubbing movement of the shutter slider 3 with the casing 5 is attained by a groove portion 13 formed on a casing element 51 of the casing 5 and two sliding bosses 14 provided on a sliding surface of the shutter slider 3 with the casing 5. The groove portion 13 formed on the casing element 51 is provided such that the shutter slider 3 can move in the direction D2 orthogonal to the rotation axial direction, i.e., the direction D1, of the photosensitive drum 110.

According to the present exemplary embodiment, the groove portion 12 of the shutter lever 4 is formed straightly in a direction inclined by 45 degrees with respect to the predetermined direction and the groove portion 13 of the casing 5 is formed straightly in the direction orthogonal to the predetermined direction as illustrated in FIGS. 7 through 9. Thereby, the driven direction of the shutter slider 3 is converted by 90 degrees with respect to the driving direction of the shutter lever 4. Then, the shutter slider 3 is slid in the direction orthogonal to the shutter lever 4 by the equal amount with the moving amount of the shutter lever 4.

In the case of the present exemplary embodiment, each of the sliding bosses 11 and 14 has a circular peripheral surface in section, i.e., a cylindrical outer peripheral surface in the present exemplary embodiment, and three in total of the sliding bosses are disposed on the shutter slider 3. Then, one sliding boss 11 is capable of entering one groove portion 12 and two sliding bosses 14 are capable of entering the groove portion 13. Therefore, the two sliding bosses 14 are arrayed in the direction orthogonal to the predetermined direction along the groove portion 13. As the shutter lever 4 moves, the groove portion 12 moves in the direction D1 and the sliding boss 11 moves along the groove portion 12 while sliding with the groove portion 12 as the side surfaces of the sliding boss 11 and the groove portion 12 abut and press with each other. At this time, because the sliding bosses 14 are guided while sliding with the groove portion 13 on the casing 5 side, the shutter slider 3 moves in the direction D2. Note that a reason why the two sliding bosses 14 are used to slide with the groove portion 13 on the casing 5 side is to cause the shutter slider 3 to move straightly along the groove portion 13 while suppressing the shutter slider 3 from turning during the operation.

Figure 11:
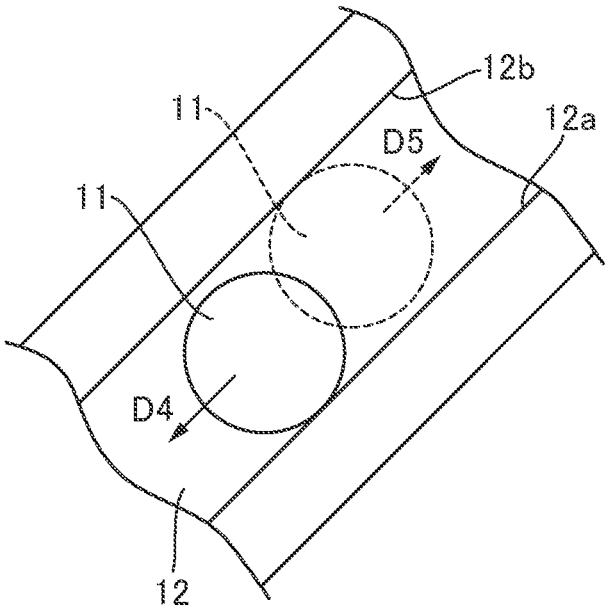
FIG. 11 is a schematic diagrammatic view illustrating a relationship between a sliding boss and a groove portion of the sensor unit of the present exemplary embodiment.

Next, a gap between the sliding boss 11 and the groove portion 12 will be described with reference to FIG. 11. FIG. 11 illustrates a state in which the sliding boss 11 of the shutter slider 3 reciprocally slides within the groove portion 12 provided on the shutter lever 4. When, the sliding boss 11 indicated by a solid line slides in a direction D4, the sliding boss 11 moves while rubbing one sliding surface 12*a* forming the groove portion 12. Meanwhile when the sliding boss 11 moves reversely, the sliding boss 11 moves in a direction D5 while rubbing a siding surface 12*b* as indicated by a broken line.

In the present exemplary embodiment, the gap is positively provided between a diameter of the sliding boss 11 of the shutter slider 3 and a width of the groove portion 12 of the shutter lever 4, i.e., a distance between the sliding surfaces 12*a* and 12*b*, such that a sliding load does not increase even if foreign substances infiltrate into the sliding portion 15 (see FIG. 5). The foreign substances assumed here are magnetic powder, i.e., carriers, contained in the developer and have an average grain size of 70 μm. Then, the gap is set at 0.2 mm so that the movement of the sliding boss 11 is not hampered even if the foreign substances adhere simultaneously on both of the sliding surfaces 12*a* and 12*b* facing with each other. That is, the gap between the outer circumferential surface of the sliding boss 11 and one surface of the sliding surfaces 12*a* and 12*b* is set to be 0.2 mm in a case where the sliding boss 11 abuts with the other surface of the sliding surfaces 12*a* and 12*b*.

Still further, a shape of a part of the sliding boss 11 where the sliding boss 11 collides against the foreign substance is preferable not to be flat but to be an inclined surface or a curved surface which can readily guide the foreign substance from an aspect of readiness of the sliding boss 11 in getting over the foreign substance adhering in a middle of the sliding surfaces 12*a* and 12*b*. Considering that the sliding boss 11 moves reciprocally, it is adequate to provide an inclined surface or a curved surface also on a counter face side. Then, it is preferable to form the sliding boss 11 into a cylindrical shape such that a contact part with the sliding surface of the sliding boss 11 does not become flat so that the foreign substance quickly exits out of the sliding surface.

An effect of decreasing the sliding resistance to a half is brought about by positively providing the gap in the sliding portion, not forming the sliding portion in a size by which the diameter of the sliding boss 11 fits with the width of the groove portion 12 without any gap. That is, the sliding resistance can be halved more than that in a case where the sliding boss 11 slides with both sliding surfaces by providing the gap because the sliding boss 11 slides with either one sliding surface and does not slide with the other sliding surface. This arrangement also provides an effect of reducing a rotational force generated in the shutter slider 3 at two reversing times of a top dead center and a bottom dead center by which the operation is reversed, in particular.

A cam angle, i.e., the inclination angle of the groove portion 12, is set at 45 degrees as described above in the cam mechanism composed of such sliding boss 11 and the groove portion 12 by considering a balance between the driving force and a shutter operation amount. Then, a ratio of a driving amount of the shutter lever 4 and a moving amount of the shutter slider 3 is set at one-to-one by setting at such angle. As the movement of the shutter slider 3 includes the two operational reversing portions as described above, it is preferable to set the cam angle at around 45 degrees in order to equalize the sliding loads of the shutter slider 3 at both portions.

Figure 12:
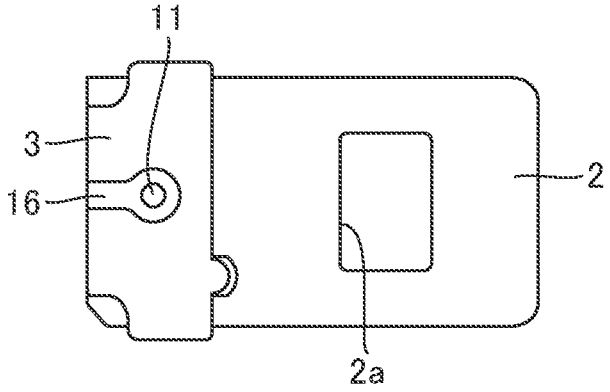
FIG. 12 is a plan view illustrating a state in which a shutter is expanded in the shutter slider and the shutter of the sensor unit of the present exemplary embodiment.
Figure 13:
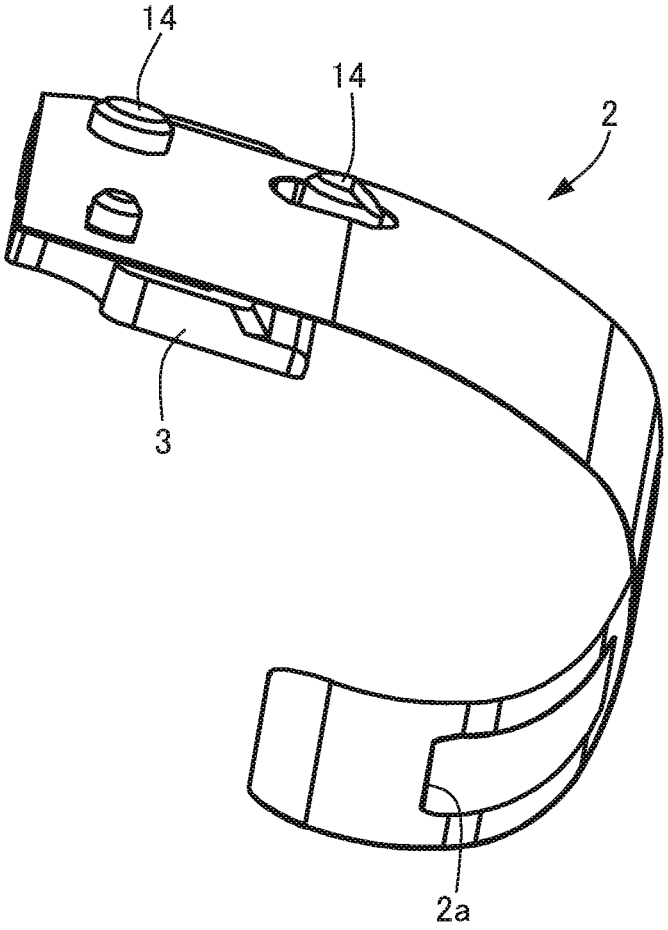
FIG. 13 is a perspective view illustrating the shutter slide and the shutter of the sensor unit of the present exemplary embodiment.

As illustrated in FIGS. 12 and 13, the shutter 2 is formed of a film in order to reduce an operation mass and is fixed to the shutter slider 3 by adhesive such that the sensor surface of the concentration sensor 7 is openable/closable by sliding the shutter 2 together with the shutter slider 3. The shutter 2 includes the opening portion 2*a* at a part thereof and in the close state, a part other than the opening portion 2*a* covers the sensor detecting surface of the concentration sensor 7 such that the sensor detecting surface is not exposed out of an opening portion 6 of the casing 5. Meanwhile, in the open state, the opening portion 2*a* faces the sensor detecting surface of the concentration sensor 7 so that the sensor detecting surface is exposed through the opening portion 6 of the casing 5.

As illustrated in FIG. 13, the shutter 2 is curved and is provided such that the shutter 2 formed into a shape of a circular arc slides on an inner surface 53 of the casing 5 covering the concentration sensor 7 to achieve the miniaturization of the whole structure including the casing 5. That is, a direction in which the tip of the shutter 2 moves is differentiated from a direction in which a base end thereof is fixed to the shutter slider 3 to reduce a space necessary for the shutter 2 to move by disposing the shutter 2 in the casing 5 while curving the shutter 2. As a result, the sensor unit 10 can be miniaturized.

Still further, it is preferable to implement a satin finish processing which is a roughening process on the sliding portion between the shutter 2 and the casing 5 to reduce a sliding resistance of the shutter 2. It is preferable to implement the satin finish processing not on the casing 5 but on the surface of the shutter 2 because the tip of the shutter 2 may be caught by the rugged part of the satin finish at a bent part on an operational locus of the shutter 2 if the casing 5 is satin-finished.

However, the casing 5 may be satin-finished. In such a case, the tip of the shutter 2 is bent such that the shutter 2 rushes smoothly to the satin-finished part to suppress such catching. Or, the shutter 2 is prolonged such that the tip of the shutter 2 is not caught by the bent part on the operational locus of the shutter 2 and such that the tip of the shutter 2 is not caught by the satin-finish part of the casing 5 in the circular arc operation of the shutter 2.

In any case, a contact area between the shutter 2 and the casing 5 can be reduced and a smooth operation can be achieved by satin-finishing either one sliding surface of the shutter 2 and casing 5 and by smoothing the other sliding surface. According to the present exemplary embodiment, the sliding surface of the shutter 2 is satin-finished such that roughness (Ra) of the sliding surface of the shutter 2 is larger than roughness of the sliding surface of the casing 5.

Sliding Portion

As illustrated in FIG. 5, the shutter slider 3 and the shutter lever 4 have the sliding portion 15 where the shutter slider 3 slides with the shutter lever 4, and the shutter slider 3 and the casing 5 have a sliding portion 16 where the shutter slider 3 slides with the casing 5. The foreign substances fallen from the developing unit 200 have been cited as a large factor of causing a sliding failure of the shutter mechanism 1 because the foreign substances infiltrate from the opening portion 6 of the casing 5, are sandwiched in the sliding portions 15 and 16 and damage the surface of the sliding surfaces. The foreign substances assumed here are magnetic powders, i.e., carriers, contained in the developer and their average grain size is around 70 μm for example.

Then, according to the present exemplary embodiment, the sliding portions 15 and 16 are disposed on an upper side of an extension line L1 of the optical axis of the light irradiated from the light emitting portion 7*a* (see FIG. 3) of the concentration sensor 7 to the photosensitive drum 110, i.e., on a side of the direction D3. That is, according to the present exemplary embodiment, the sliding portions 15 and 16 are disposed upstream in the rotation direction of the photosensitive drum 110 from the extension line L1 of the optical axis on a plane orthogonal to the rotation axial line of the photosensitive drum 110. It is possible to remarkably reduce a possibility of causing the sliding failure of the shutter slider 3 because the carriers which are relatively heavy metal particles infiltrated from the opening portion 6 fall and accumulate in a space Sp where no sliding portions 15 and 16 exist by adopting the configuration of the present exemplary embodiment.

Figure 10:
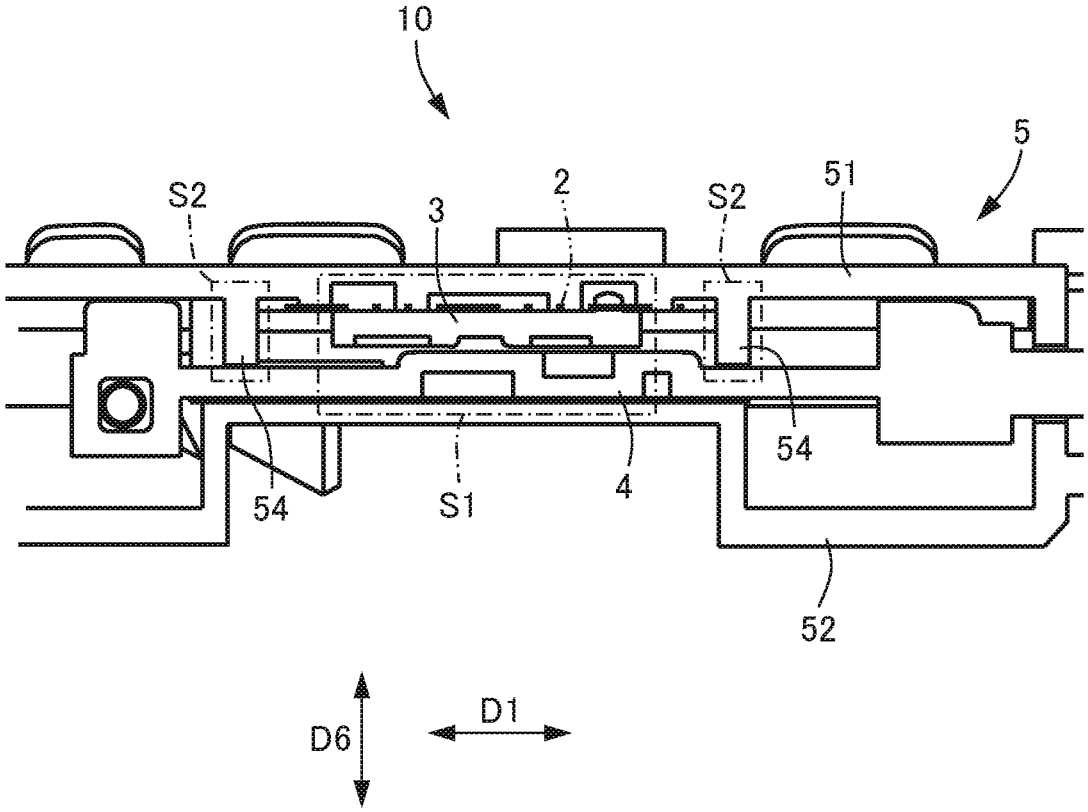
FIG. 10 is a front view illustrating the shutter lever and the shutter slider of the sensor unit of the present exemplary embodiment.

Still further, as illustrated in FIG. 10, the shutter lever 4 and the shutter slider 3 are disposed so as to be slidable by overlapping in an overlap direction D6 such that the surfaces on which the sliding boss 11 and the groove portion 12 are formed face with each other. The shutter lever 4 is supported by the casing 5 so as to be slidable in the direction D1 and to be regulated in the overlap direction D6. According to the present exemplary embodiment, the shutter lever 4 is in surface contact with a casing element 52 and is held by holding portions 54 provided in the casing element 51. Thereby, the shutter lever 4 is regulated in the overlap direction D6 by the holding portions 54 and the casing element 52 and is regulated in the direction D2 by the holding portions 54 as illustrated in FIG. 9. In the present exemplary embodiment, ribs having a width of 2 mm provided on the casing 5 are used as the holding portions 54.

If the holding portion 54 is formed at a position overlapping with the sliding portion 15 of the shutter lever 4 and the shutter slider 3 in the overlap direction D6, the holding portion 54 presses the sliding portion 15 in the overlap direction D6. In this case, if a pressing force of the sliding portion 15 is strong due to an allowance or the like and hampers the opening/closing operation of the shutter 2, the gap between the sliding boss 11 and the groove portion 12 and the operation thereof may not be adequately maintained.

Then, according to the present exemplary embodiment, the holding portions 54 are disposed in a region other than the sliding portion 15, i.e., in an outside area of the sliding portion 15, in a view from the overlap direction D6. This arrangement makes it possible to suppress the holding portions 54 from pressing the sliding portion 15 in the overlap direction D6 and from hampering the opening/closing operation of the shutter 2. An area S1 of the sliding portion 15 is set to be larger than an area S2 in which the regions of the shutter lever 4 overlapping with the holding portions 54 are totaled. Thereby, the sliding resistance generated by the movement regulation of the shutter lever 4 by the holding portions 54 becomes smaller than the sliding resistance generated by the shutter slider 3 sliding with the shutter lever 4. It is also possible to reduce a risk of catching foreign substances on a movement regulating surface by reducing the area S2 in contact with the shutter lever 4 and the holding portions 54. The holding portions 54 are also provided at two places across the sliding portion 15. This arrangement makes it possible to stably hold the shutter lever 4.

According to the image forming apparatus 100 of the present exemplary embodiment, the sliding portion 15 of the shutter lever 4 and the shutter slider 3 is disposed above the extension line L1 of the optical axis of the light irradiated from the light emitting portion 7*a* to the photosensitive drum 110 as described above. Therefore, the carriers which are relatively heavy metal particles infiltrated from the opening portion 6 tend to fall and accumulate in the space Sp where no sliding portions 15 and 16 exist. This arrangement makes it possible to remarkably reduce a possibility of causing sliding failure of the shutter slider 3, to suppress abrasion of the shutter mechanism 1 and to realize a stable and durably shutter opening/closing operation. That is, this arrangement makes it possible to reduce the infiltration of the foreign substances into the sliding portion 15 of the shutter mechanism 1 of the shutter 2 and to improve replacement intervals, to suppress a downtime and to reduce a service load of the sensor unit 10.

Still further, according to the image forming apparatus 100 of the present exemplary embodiment, the holding portions 54 hold so as to regulate the movement of the shutter lever 4 in the overlap direction D6 in the regions other than the sliding portion 15 of the shutter lever 4 and the shutter slider 3. Therefore, it is possible to suppress the holding portions 54 from pressing the sliding portion 15 in the overlap direction D6 and to arrange such that the holding portions 54 do not hamper the opening/closing operation of the shutter 2.

According to the image forming apparatus 100 of the present exemplary embodiment, the shutter stroke is reduced, so that the time required for opening/closing the shutter 2 is shortened. Due to that, it is possible to reduce a toner amount otherwise adhering on the sensor surface of the concentration sensor 7.

Other Embodiments

While the exemplary embodiment described above has been described about a case where the sliding portion 15 is disposed above the extension line L1 of the optical axis and where the holding portions 54 are provided in the regions other than the sliding portion 15, the present disclosure is not limited to such configuration. For instance, the holding portions 54 may be provided so as to overlap with the sliding portion 15 if the sliding portion 15 is disposed above the extension line L1 of the optical axis. Or, the sliding portion 15 may be disposed under the extension line L1 of the optical axis if the holding portions 54 are provided in regions other than the sliding portion 15.

Still further, while the case where the area S1 of the sliding portion 15 is provided to be larger than the area S2 totaling the regions of the shutter lever 4 overlapping with the holding portions 54 has been described in the exemplary embodiment described above, the present disclosure is not limited to such configuration. For instance, the area S1 may be smaller than the area S2.

Still further, while the sensor unit 10 is disposed under the developing sleeve 201 because the process cartridge 9 is provided above the intermediate transfer belt 24 in the exemplary embodiment described above, the present disclosure is not limited to such configuration. For instance, the sensor unit 10 may be disposed above the developing sleeve 201 in a case where the process cartridge 9 is provided under the intermediate transfer belt 24. In such a case, although the foreign substances from the developing unit 200 do not fall directly onto the sensor unit 10, the similar effect with the present exemplary embodiment can be obtained in a case where floating foreign substances infiltrate from the opening portion 6.

Figure 14:
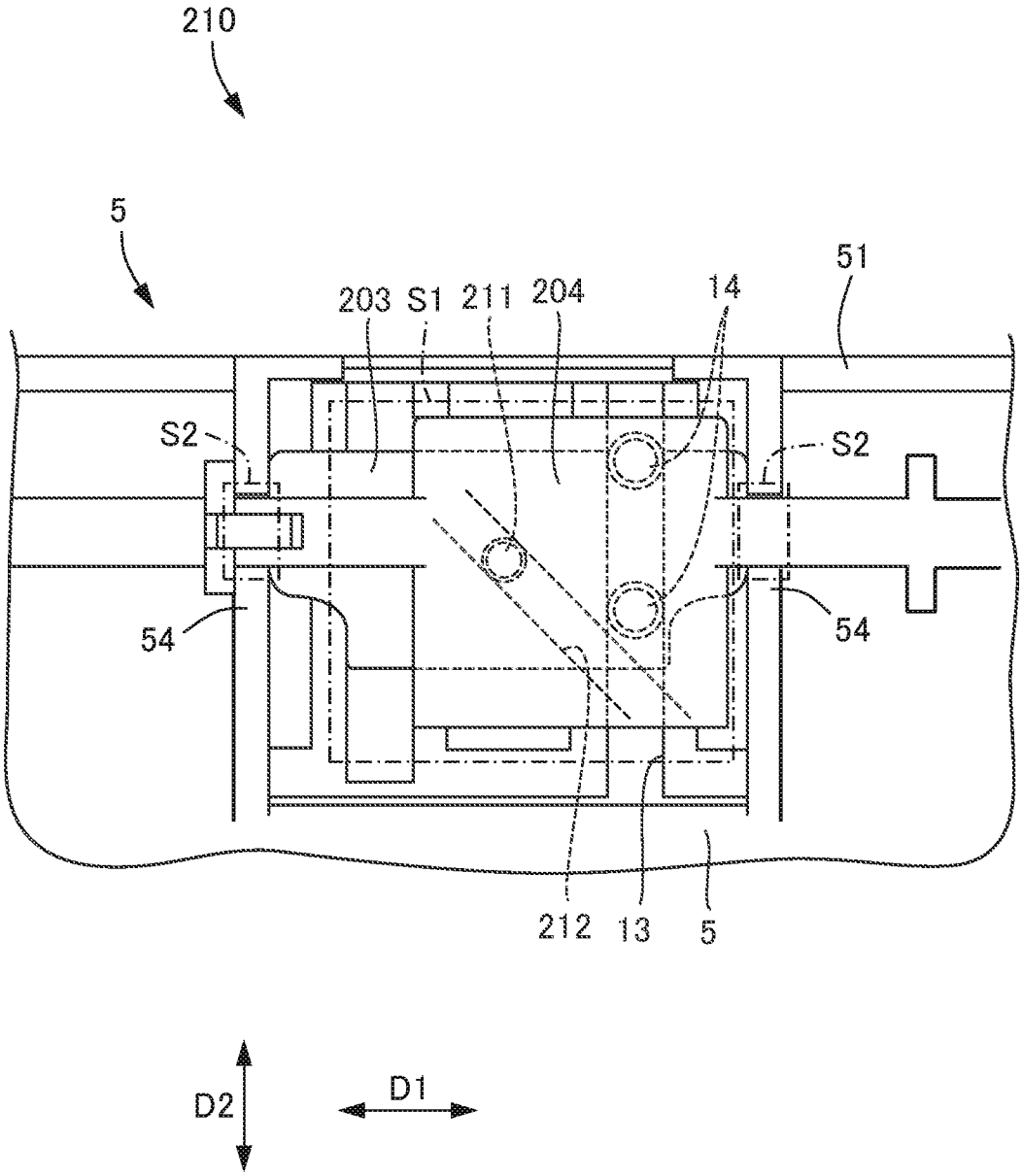
FIG. 14 is a bottom view illustrating a cam mechanism of the shutter lever and the shutter slider of the sensor unit of another embodiment.

Still further, while the groove portion 12 is provided in the shutter lever 4 and the sliding boss 11 is provided in the shutter slider 3 in the configuration of the present exemplary embodiment, the similar effect with the present exemplary embodiment can be obtained even in a configuration in which the sliding boss is provided in the shutter lever 4 and the groove portion is provided in the shutter slider 3. In this case, as illustrated in FIG. 14, in a sensor unit 210, a sliding boss 211 is provided in a shutter lever 204 and a groove portion 212 is provided in the shutter slider 203, for instance.

Still further, while the optical sensor has been the concentration sensor in the exemplary embodiment described above, the present disclosure is not limited to such configuration and the optical sensor may be a sensor that detects a color shift amount of images formed by each of the image forming units PY, PM, PC and PK. Still further, while the optical sensor has been configured to detect the toner image on the photosensitive drum 110 in the exemplary embodiment described above, the present disclosure is not limited to such configuration. For instance, the similar effect with the exemplary embodiment described above can be obtained by applying the inventive configuration even in a case where the optical sensor is configured to detect images formed on the intermediate transfer belt serving as an image bearing member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-114839, filed Jul. 2, 2020, which is hereby incorporated by reference herein in its entirety.

What is claimed is:

1. An image forming apparatus comprising:
a rotatable image bearing member;
an image forming unit configured to form an image on the image bearing member;
a detection unit configured to detect a toner image formed on the image bearing member; and
a control portion configured to control the image forming unit based on a detection result of the detection unit,
the detection unit comprising:
a casing having an opening portion;
an optical sensor disposed within the casing facing the image bearing member to detect the toner image and comprising a light emitting portion configured to emit light to the image bearing member through the opening portion and a light receiving portion configured to receive the light reflected from the image bearing member;
a shutter portion comprising a shutter configured to open/close the opening portion;
a moving member configured to reciprocally move along a predetermined direction;
a groove portion provided on the moving member and extended in a direction intersecting with the predetermined direction; and
a projection portion provided on the shutter portion and engaging with the groove portion,
wherein the shutter is configured to open/close the opening portion as the projection portion moves in a direction intersecting with the predetermined direction as the moving member moves in the predetermined direction, and
wherein the groove portion is disposed perpendicularly above an extension line of an optical axis of the light irradiated from the light emitting portion to the image bearing member.

2. The image forming apparatus according to claim 1,
wherein the shutter is formed of an elastic sheet,
wherein the shutter portion comprises a support member configured to support the elastic sheet, and
wherein the projection portion is provided on the support member.

3. The image forming apparatus according to claim 1, further comprising a developing unit,
wherein the image bearing member is a photosensitive member,
wherein the developing unit includes a developer bearing member capable of developing an electrostatic latent image formed on the photosensitive member with developer into a toner image, and
wherein the detection unit is disposed perpendicularly below the developer bearing member.

4. The image forming apparatus according to claim 1, wherein the shutter moves along a rotation direction of the image bearing member.

5. The image forming apparatus according to claim 1, wherein the image bearing member and the detection unit are integrally provided in a cartridge attachable to/detachable from the image forming apparatus.

6. The image forming apparatus according to claim 1, wherein the predetermined direction is a direction in parallel with a rotation axial direction of the image bearing member.

7. An image forming apparatus comprising:
a rotatable image bearing member;
an image forming unit configured to form an image on the image bearing member;
a detection unit configured to detect a toner image formed on the image bearing member; and
a control portion configured to control the image forming unit based on a detection result of the detection unit,
the detection unit comprising:
a casing having an opening portion;
an optical sensor disposed within the casing facing the image bearing member to detect the toner image and comprising a light emitting portion configured to emit light to the image bearing member through the opening portion and a light receiving portion configured to receive the light reflected from the image bearing member;
a shutter portion comprising a shutter configured to open/close the opening portion;
a moving member configured to reciprocally move along a predetermined direction;
a groove portion provided on the shutter portion and extended in a direction intersecting with the predetermined direction; and
a projection portion provided on the moving member and engaging with the groove portion,
wherein the shutter is configured to open/close the opening portion as the groove portion moves in a direction intersecting with the predetermined direction as the moving member moves in the predetermined direction, and
wherein the groove portion is disposed perpendicularly above an extension line of an optical axis of the light irradiated from the light emitting portion to the image bearing member.

8. The image forming apparatus according to claim 7,
wherein the shutter is formed of an elastic sheet,
wherein the shutter portion comprises a support member configured to support the elastic sheet, and
wherein the groove portion is provided on the support member.

9. The image forming apparatus according to claim 7, further comprising a developing unit,
wherein the image bearing member is a photosensitive member,
wherein the developing unit includes a developer bearing member capable of developing an electrostatic latent image formed on the photosensitive member with developer into a toner image, and wherein the detection unit is disposed perpendicularly below the developer bearing member.

10. The image forming apparatus according to claim 7, wherein the shutter moves along a rotation direction of the image bearing member.

11. The image forming apparatus according to claim 7, wherein the image bearing member and the detection unit are integrally provided in a cartridge attachable to/detachable from the image forming apparatus.

12. The image forming apparatus according to claim 7, wherein the predetermined direction is a direction in parallel with a rotation axial direction of the image bearing member.

* * * * *